US005087855A

United States Patent [19]

Overbeek et al.

[11] Patent Number: 5,087,855

[45] Date of Patent: Feb. 11, 1992

[54] DISPLAY TUBE WITH ELECTRICAL CONNECTION MEANS

[75] Inventors: Johannes J. M. Overbeek; Hendrik A. Verkuijlen, both of Eindhoven, Netherlands

[73] Assignee: U.S. Philips Corporation, New York, N.Y.

[21] Appl. No.: 550,769

[22] Filed: Jul. 10, 1990

[30] Foreign Application Priority Data

Jul. 18, 1989 [NL] Netherlands ..... 8901845

[51] Int. Cl.[5] ..... H01J 29/88; H01J 29/92

[52] U.S. Cl. ..... 313/477 HC; 313/479; 313/481; 313/466

[58] Field of Search ..... 313/477 HC, 479, 466, 313/481

[56] References Cited

U.S. PATENT DOCUMENTS

| | | | |
|---|---|---|---|
| 3,898,510 | 8/1975 | Davis et al. | 313/479 X |
| 4,182,974 | 1/1980 | Van Ijzeren | 313/481 |
| 4,344,015 | 8/1982 | Marschka | 313/477 HC X |
| 4,450,379 | 5/1984 | Kikuchi et al. | 313/477 HC |
| 4,739,215 | 4/1988 | Adamski | 313/466 X |
| 4,845,404 | 7/1989 | Van Buren | 313/477 HC |

*Primary Examiner*—Palmer C. DeMeo
*Attorney, Agent, or Firm*—Paul R. Miller

[57] ABSTRACT

Display tube including an envelope portion 2 coated with a first electrically conducting layer 7 and a display window 1 coated with a second electrically conducting layer 8 has a connection means having two tongue-shaped members 11 and 12 and fastened to a high-voltage contact 13. The tongue-shaped members 11 and 12 extend on both sides of the high-voltage contact 13 and bear against the electrically conducting layers 7 and 8, respectively.

8 Claims, 2 Drawing Sheets

DISPLAY TUBE WITH ELECTRICAL CONNECTION MEANS

BACKGROUND OF THE INVENTION

The invention relates to to a display tube including an envelope portion which at its interior side is coated with a first electrically conducting layer and a display window which is connected to the envelope portion and at its interior side is coated with a second electrically conducting layer.

A display tube of the type defined in the opening paragraph is generally used for the display of monochrome pictures, colour pictures or for displaying figures or letters (Data Graphic Displays ). In practice it was, however, found that in some cases the display of a picture is not always effected in the desired manner and disadvantageous effects occur.

OBJECTS AND SUMMARY OF THE INVENTION

It is inter alia an object of the invention to provide a display tube in which at least in a number of cases the occurrence of the disadvantageous effects is prevented.

According to the invention, a display tube of the type defined in the opening paragraph is characterized in that the display tube includes a connection means, the connection means comprising a base portion connected to a high-voltage contact provided in the envelope portion, a first tongue-shaped member bearing against the first layer and a second tongue-shaped member bearing against the second layer, the tongue-shaped members extending on both sides of the high-voltage contact from the base portion.

The invention is based on the recognition that at least part of the disadvantageous effects are caused by the first electrically conducting layer not being electrically connected to a sufficient extent to the second electrically conducting layer whereby the supply of a voltage to the layers is not adequate in some cases. Electron beams generated by an electron generating system provided in the envelope portion can disadvantageously be influenced on their path to a display screen provided at the interior side of the display window by unwanted electro-magnetic fields which are caused by an insufficient electrical connection between the two conducting layers. This causes an uncontrollable and unwanted shift of the electron beams which results in a distortion in a picture to be displayed.

A display tube of the invention has been found to ensure an adequate electrical connection between the two conducting layers because of the mechanically very stable connection provided by the fact that the two tongue-shaped members extend on both sides of the supporting element. In addition, an appropriate voltage supply to the layers is obtained in a simple manner because the high-voltage contact is used as an electrical feed-through.

A preferred embodiment of a display tube according to the invention is characterized in that the second tongue-shaped member is provided with an element bearing against the first conducting layer. An alternative preferred embodiment is characterized in that the connection means is provided with a third tongue-shaped member which extends in substantially the same direction from the base portion as the second tongue-shaped member and in that the third tongue-shaped member bears against the first layer.

A further alternative preferred embodiment is characterized in that the connection member is provided with third and fourth tongue-shaped members which extend substantially in the same direction from the base portion as the second tongue-shaped member, that the third and fourth tongue-shaped members bear against the first layer, the second tongue-shaped member being located between the third and fourth tongue-shaped members.

As a result thereof the electrical connection between the two conducting layers is preserved even at the occurrence of heavy vibrations and shocks.

A further preferred embodiment of a picture tube according to the invention is characterized in that the base portion is connected to the high-voltage contact while a bias voltage is applied thereto and each tongue-shaped member bears against the associated electrically conducting layer under a spring action. This provides in a simple manner an appropriate contact of each tongue shaped member with its associated conducting layer.

In a preferred embodiment of a display tube in accordance with the invention, connection means includes a base portion of a strip-shaped element, from the ends of which the tongue-shaped members extend, whereby the connection means can be produced as one integral whole in a simple manner.

The base portion of the connection element can be fastened in many different ways to the supporting element. In a preferred embodiment of a display tube of the invention in which the high-voltage contact includes an element which extends from the inner wall of the envelope portion, which element is provided at its end with an at least partially flaring portion, and the base portion partially bears against the flaring portion under spring action, the spring action is also used in a simple manner to obtain a proper bearing of the tongue-shaped members against the conducting layers. Fastening the connection means to the supporting element and the bearing of the tongue-shaped members against the conductive layers is thus realised in an integrating manner, so that the connection means comprises the lowest possible number of components.

Preferably, the end of each tongue-shaped member is spoon-shaped, which provides an appropriate bearing against the associated conducting layer with no risk of loose particles or scratches being produced during assembling of the tube components.

The mechanical stability of the connection means renders it particularly suitable for supporting a getter device suitable for containing getter material.

BRIEF DESCRIPTION OF THE DRAWING

Some embodiments of a display tube according to the invention will be described in greater detail by way of example with reference to the accompanying drawing, in which.

DESCRIPTION OF THE PREFERRED EMBODIMENTS

Figure 1:
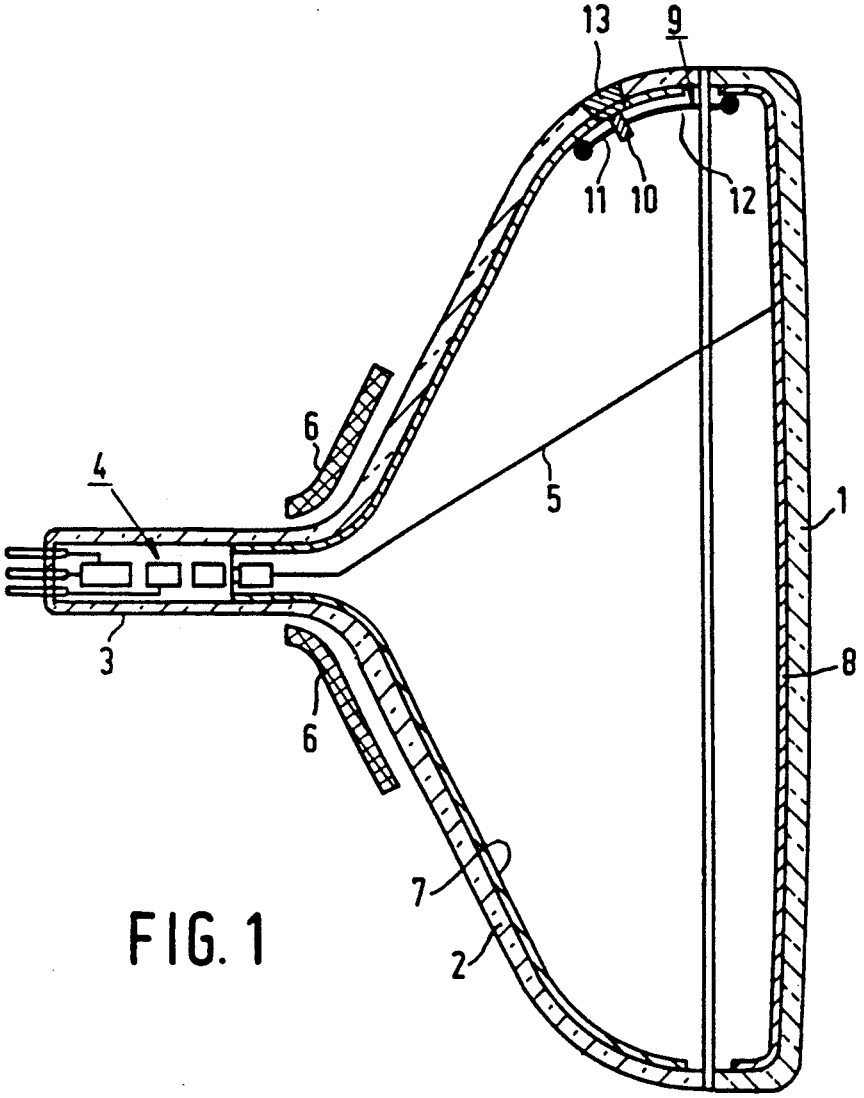
FIG. 1 is a schematic cross-sectional view of a display tube according to the invention.

The display tube shown in FIG. 1 in a longitudinal cross-sectional comprises a glass envelope comprising a display window 1, a cone-shaped envelope portion 2 and a neck portion 3. The neck portion 3 includes an electron generating system 4 for generating an electron beam 5 which is directed to a display screen (not shown) provided on the interior of the display window 1. On its path to the display screen the electron beam 5 is deflected over the display screen with the aid of a plurality of deflection coils 6 which are coaxially positioned around the tube axis. The interior wall of the envelope portion 2 is provided with a first electrically conducting layer 7 and the interior wall of the display window 1 is provided with a second electrically conducting layer 8. The first electrically conducting layer 7 can be made of a resistance material composed of, for example, a mixture of ferrioxide, graphite and potassium silicate, and the second electrically conducting layer 8 is, for example, a thin aluminum layer provided on the inner surface of the display screen. The two electrically conducting layers 7 and 8 are electrically interconnected by a connection means 9 which comprises a base portion 10, a first (11) and a second (12) tongue-shaped member. The base portion 10 is connected to a high-voltage contact 13, for example, by welding or in an alternative embodiment by means of a clamping structure, in the envelope portion 2. The two tongue-shaped members 11 and 12 extend on both sides of the high-voltage contact 13 from the base portion 10. The end of the first tongue-shaped member bears against the first electrically conducting layer 7 and the end of the second tongue-shaped member 12 bears against the second electrically conducting layer 8. The desired voltage can be applied to the conducting layers 7 and 8 via the high-voltage contact 13. The connection means 9 provides a very stable electrical interconnection of the two electrically conducting layers 7 and 8.

Some embodiments of connection means in a display tube according to the invention will be described in greater detail by way of example with reference to the FIGS. 2 to 5.

Figure 2:
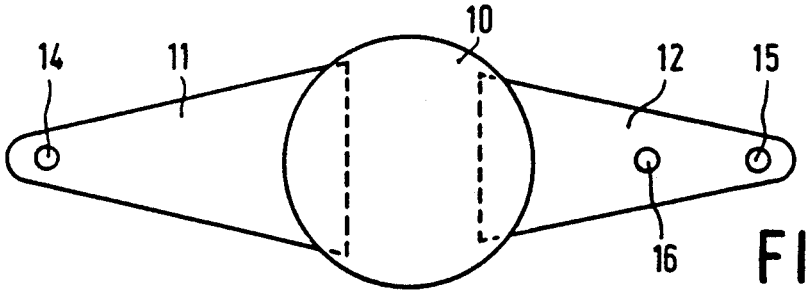
FIG. 2 to 4 are plan views and FIG. 5 is a section view of some embodiments of connection means suitable for use in the display tube of FIG. 1, and FIGS. 6 and 7 are schematic cross-section views of a connection means connected to a high-voltage contact in a display tube in accordance with the invention.

FIG. 2 shows schematically a connection means having a base portion 10 which is constituted by a disc-shaped or cylindrical element to be connected to the high-voltage contact. The first tongue-shaped member 11 is provided with a bulge 14 which, when the base portion 10 is connected to the high-voltage contact, bears against the electrically conducting layer on the envelope portion. The second tongue-shaped member 12 is provided with two bulges 15 and 16, of which bulge 15 is intended to bear against the electrically conducting layer on the display window and bulge 16 is intended to bear against the electrically conducting layer on the envelope portion.

Figure 3:
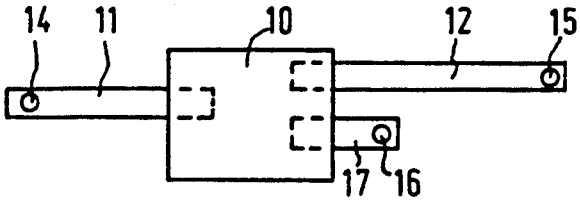

FIG. 3 shows an alternative embodiment of a connection means in which the base portion 10 has a rectangular shape and the bulge 16 is provided on a third tongue-shaped member 17. The bulges 14, 15 and 16 may, for example, be partly spherical elements which are fastened to the tongue-shaped members or are pressed into the tongue-shaped members. The tongue-shaped members 11, 12 and 17 are, for example, strip-shaped elements which are fastened to the base portion, for example by welding. In an alternative embodiment, shown schematically in FIG. 4, the base portion and the tongue-shaped members are made from a strip-shaped element. The ends 14, 15 and 16 of the tongue-shaped members are, in this embodiment, in the form of a spoon (see FIG. 5) which provides the advantages already mentioned.

Figure 4:
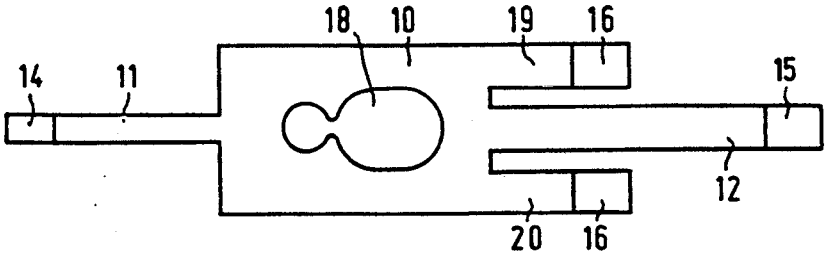

FIG. 4 shows a connection means having a base portion 10 which at one side has a tongue-shaped portion 11 and at the opposite side a (long) tongue-shaped portion 12 arranged between (short) tongue-shaped portions 19 and 20. (Alternatively, two tongue-shaped portions 11 can be provided for the purpose of increasing the stability of the assembly. The connection means as shown in FIG. 4 provides that the electrical connection between the two layers is preserved, even at the occurrence of heavy vibrations and shocks, because the second tongue-shaped member 12 is located between a third and fourth tongue-shaped member 19 and 20, respectively.

An appropriate contact of the tongue-shaped members against the conducting layer is obtained by connecting the base portion to the high-voltage contact by pre-tension so that each tongue-shaped member bears against the associated electrically conducting layer under spring action.

Figure 5:
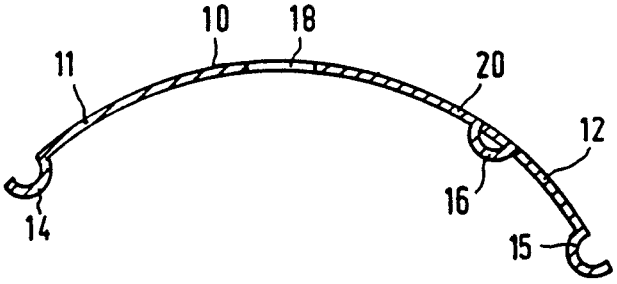

The pre-tension is, for example, obtained by imparting a curved shape to the connection means, as is shown in FIG.5.

Figure 6:
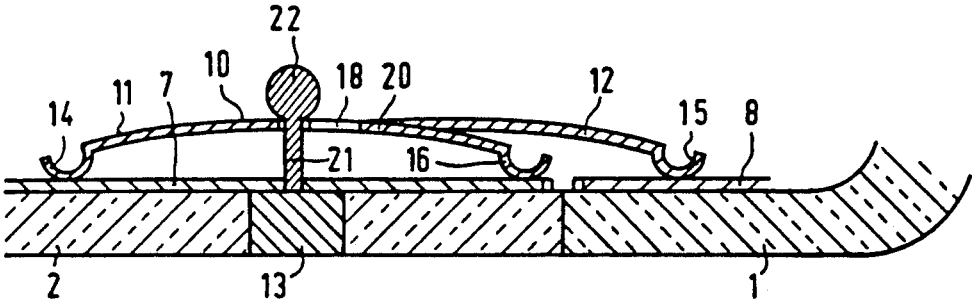
Figure 7:
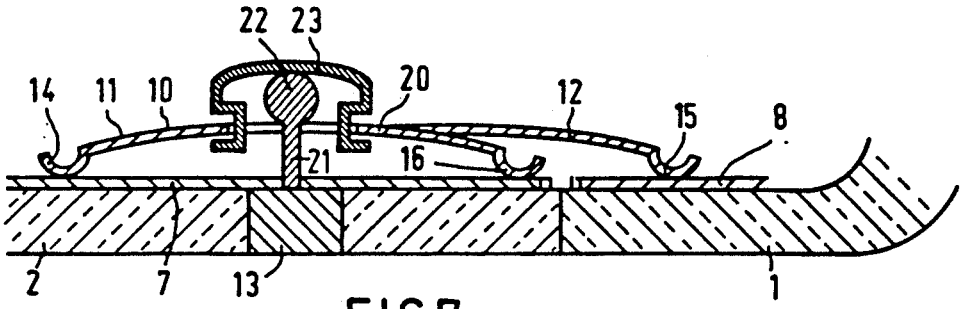

In a preferred embodiment, an element 21 is connected to the high-voltage contact 13, which more specifically may be in the form of a nipple and extends from the contact 13 and has an at least partly widened free end 22, in this case of a spherical form (see the schematical views in FIGS. 6 and 7). If the base portion 10 bears against the widened end 22, then the curvature of the connection means in reduced and the spoon-shaped ends 14, 15 and 16 bear against the electrically conducting layers under spring action.

Connecting the connection means to the high-voltage contact 13 can be effected with the aid of a clamping structure 23 (see FIG. 7) but is preferably effected by providing the base portion 10 of the connection means with such an aperture 18 (see FIGS. 4 and 6) that a part of the base portion 10 bears directly against widened end 22 of nipple 21.

More specifically, the aperture 18 in the base portion 10 is in the form of a slotted hold with an ample insert portion 18*a* and a narrow fixing portion 18*b* (FIG. 4). If the orientation of the aperture (slotted hole) 18 is as shown in FIG. 4, then the connection means can be positioned such that the ample portion of the aperture 18 is over free end 22 and the connection means can be secured on it by depressing the connection means and sliding it laterally towards the display screen. This is a very suitable method especially for small display tubes, such as projection TV tubes. When the connection means is used in larger tubes, the aperture (slotted hole) 18 may be rotated through 180° as compared with the situation shown in FIG. 4 as this provides more room. In that case the connection means is fixed after having been placed in position, by means of the narrow portion of the aperture 18 on the tree by depressing and sliding in a direction away from the screen.

In view of the adequate stability of the assembly of the connection means of the invention to the high-voltage contact, the connection means is suitable for supporting a getter device 24 (see Fig.6) suitable for containing getter material. In that case the getter arrangement may be secured on, for example, the structure shown in FIG. 4.

What is claimed is :

1. A display tube comprising (a) an envelope structure having a first electrically conductive coating at an interior surface, (b) a display window connected to said envelope structure, said display window having a second electrically conductive coating at an interior side, (c) a high voltage contact disposed through said envelope structure, said high voltage contact including a pillar with a widened end structure, (d) connection means for connecting high voltage from said high voltage contact to each of said first electrically conductive coating and said second electrically conductive coating, said connection means having a curved shape, said connection means including (i) a strip-shaped base member having a locking opening for receiving said widened end structure of said high voltage contact, (ii) at least one first elongated tongue member disposed at one end of said strip-shaped base member and extending to a first contact end, (iii) a second elongated tongue member disposed at an opposite end of said strip-shaped base member and extending to a second contact end, and (iv) a pair of arms disposed adjacent to said second tongue member and extending from said opposite end of said strip-shaped base member, said pair of arms each being shorter in length than said second tongue member, and said pair of arms each having respective third and fourth contact ends, wherein said widened end structure of said high voltage contact pulls said connection means under tension to dispose said first, third and fourth contact ends against said first electrically conductive coating and said second contact end against said second electrically conductive coating.

2. A display tube according to claim 1, wherein said first, second, third and fourth contact ends each are spoon-shaped.

3. A display tube according to claim 1, wherein two of said first elongated tongue members are disposed at said one end of said strip-shaped base member.

4. A display tube according to claim 1, wherein said pair of arms are disposed at respective sides of said second tongue member.

5. A display tube according to claim 1, wherein said curved connection means is disposed under spring action with said tension.

6. A display tube according to claim 1, wherein said widened end structure of said pillar has a spherical shape.

7. A display tube according to claim 1, wherein a clamping structure further connects said high voltage contact to said connection means.

8. A display tube according to claim 1, wherein a getter device is disposed with said connection means to contain getter material.

* * * * *